United States Patent [19]

Schneider, Jr.

[11] 4,378,740

[45] Apr. 5, 1983

[54] MUNITION FUSE SYSTEM HAVING OUT-OF-LINE SAFETY DEVICE

[75] Inventor: Clayton J. Schneider, Jr., East Aurora, N.Y.

[73] Assignee: Calspan Corporation, Buffalo, N.Y.

[21] Appl. No.: 197,307

[22] Filed: Oct. 15, 1980

[51] Int. Cl.[3] ..... F42C 15/40

[52] U.S. Cl. ..... 102/216; 102/231; 102/262; 102/267; 102/503

[58] Field of Search ..... 102/206, 216, 201, 231, 102/235, 262, 267, 503

[56] References Cited

U.S. PATENT DOCUMENTS 3,181,466 5/1965 Czajkowski ..... 102/206

3,877,383 4/1975 Flatau ..... 102/503

*Primary Examiner*—Charles T. Jordan

*Attorney, Agent, or Firm*—Biebel, French and Nauman

[57] ABSTRACT

An out-of-line fuse for primarily ring-type, multiple point concurrent initiation, projectiles is disclosed. In the unarmed state, the detonator and booster charges are angularly displaced while located at the same radial distance from the projectile axis in adjacent radial planes. When rotation of the projectile is sensed by a plurality of centrifugally actuated fiber optic light switches arranged in a series optical relationship, an electrically activated pyrotechnic thruster is fired to move the detonator charges and the booster charges into alignment arming the projectile; the electrical circuit having been priorly energized by inertia switches sensing the thrust forces during the launching of the projectile. When rotation of the projectile substantially ceases the detonator charges are electrically fired.

13 Claims, 14 Drawing Figures

MUNITION FUSE SYSTEM HAVING OUT-OF-LINE SAFETY DEVICE

BACKGROUND OF THE INVENTION

The field of the invention is in the military projectile art and more particularly in the art of arming and firing ring air foil type projectiles. In the light of safety, it is required that the explosive train for a munition be secured prior to arming in an out-of-line condition, that is, the charges physically positioned in such a manner that neither the main charge nor any of the booster charges will fire in the event of the unintentional detonation of primary explosive initiators in the fuze. The design difficulties inherent in this requirement are increased by a munition which needs multiple-point, concurrent initiation, as do many of the modern, more stable, mass focused charge types of munitions. The difficulties of a suitable safe design are further compounded by a munition geometry which requires that the center axis of the projectile be free from fuze components, such as in the case with ring air foil projectiles.

Ring air foil projectiles with conventional explosive charges are known. The aforementioned problems have, prior to this invention, precluded the feasible fabrication of shaped charge, multiple point, ignition, high explosive projectiles for ring air foil projectiles.

SUMMARY OF THE INVENTION

The invention provides a novel, out-of-line to an in-line, safe-to-arm, structure for the detonator and booster charges in a multiple point initiation fuze primarily for hollow projectiles. The booster charges and detonator charges are angularly displaced prior to arming such that should a detonator charge malfunction and fire, neither the associated booster charge nor any other booster charge will be ignited. The sequence of operation of the disclosed fuze provides, first, for electrical arming of the electrical control circuit by the operation of a plurality of inertia power switches activated by the inertial forces (conventionally referred to as "set back" forces), occurring at launching of the projectile. Then, after the electrical circuits of the fuze are activated, rotational forces initiated with the spinning of the projectile are sensed by a plurality of centrifugally actuated fiber optic light sensor switches in series optical relationship, and when rotation of the projectile has been established by the centrifugal light sensor switches, an electrical circuit to an electrically ignited pyrotechnic thruster is activated. The thruster then fires and rotates a moveable ring in a track to bring the detonators and boosters into alignment. At this point, the projectile is fully armed and is in its trajectory toward the target. Detonation of the projectile generally occurs by electrical ignition when the fiber optic light sensors sense a cessation, or a substantial lowering of rotational velocity. The projectile may alternatively detonate on severe impact.

It is therefore an object of the invention to provide an out-of-line-until-armed fuze train suitable for ring-type projectiles.

It is another object of the invention to provide an arming system for ring-type projectiles that requires an axial thrust force and a rotational force to become fully armed.

It is yet an additional object of the invention to provide an arming system suitable for ring-type projectiles that initiates detonation upon sensing a substantial decrease in rotational velocity of the projectile.

DESCRIPTION OF THE PREFERRED EMBODIMENT

Figure 1:
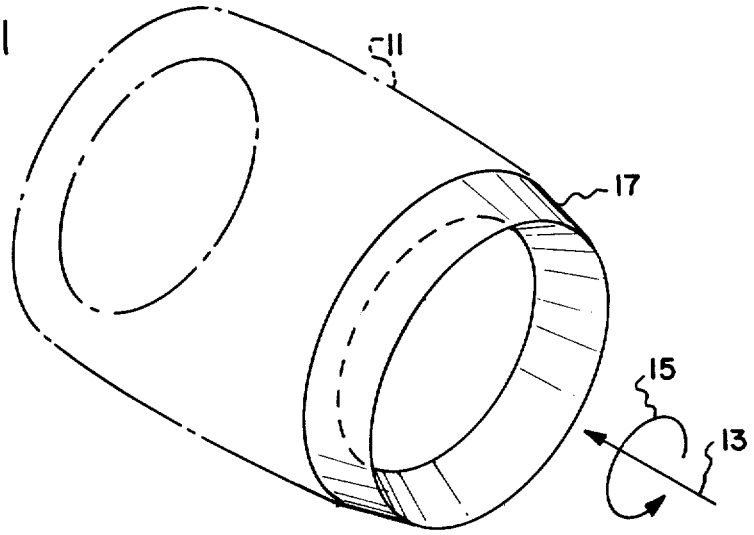
FIG. 1 illustrates, in phantom, a conventional ring air foil projectile having a trailing edge fuze enclosure.

FIG. 1 schematically illustrates in phantom a typical, conventional, ring airfoil projectile 11. The explosive is contained in a conventional metal casing. The projectile is launched along a longitudinal axis 13 with stabilizing rotation 15 about the axis 13. Axis 13 is also along the trajectory of the projectile. Attached to the trailing end of the projectile case is enclosure 17 which contains the components of the fuze. The enclosure 17 is generally faired in with the lines of the projectile to continue the aerodynamic shape of the projectile. The enclosure is conventially attached to the track 21 (FIG. 2) which is also conventionally attached to the explosive case 11 by rivets 22 or other conventional means. The fuze enclosure also may just as well be formed integral with the projectile casing rather than being separately attached.

Figure 2:
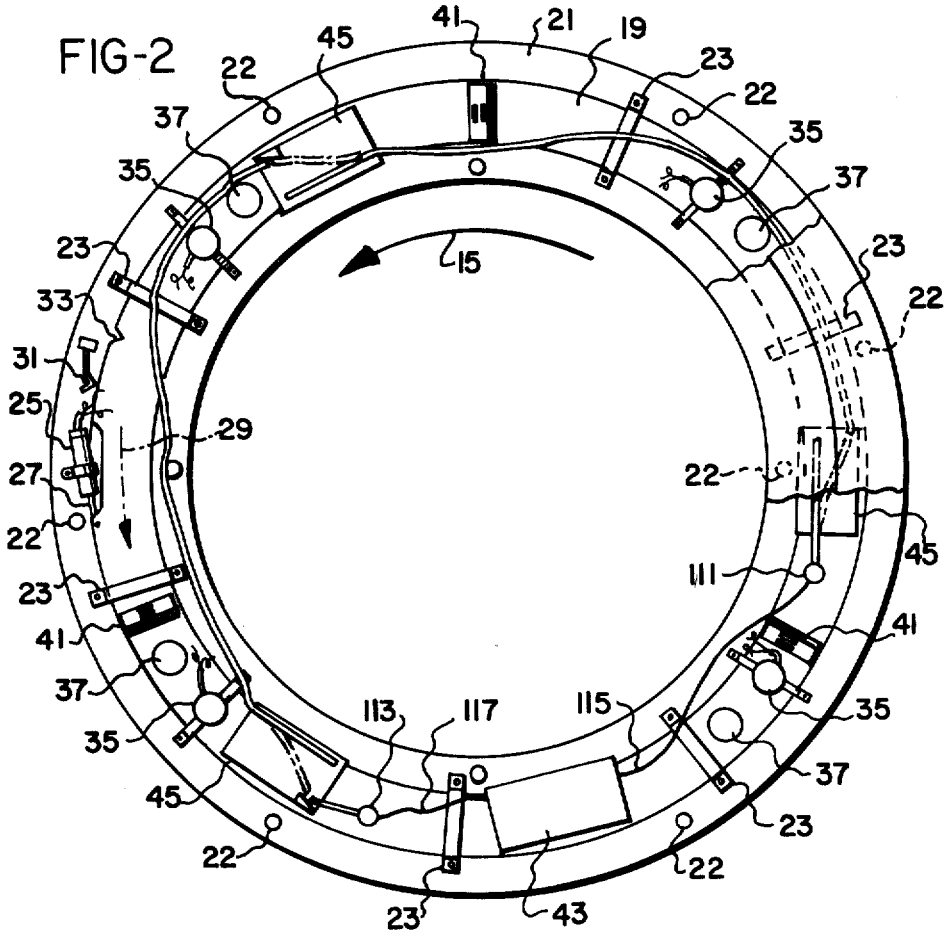
FIG. 2 schematically illustrates an embodiment of the invention.
Figure 3:
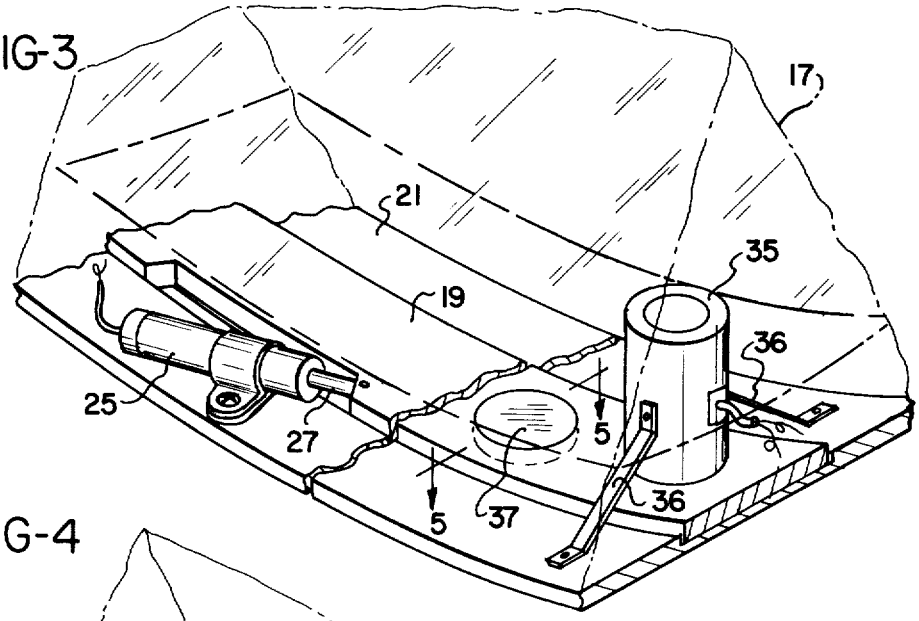
FIG. 3 schematically illustrates the out-of-alignment, unarmed condition of a booster charge and a detonator charge.
Figure 4:
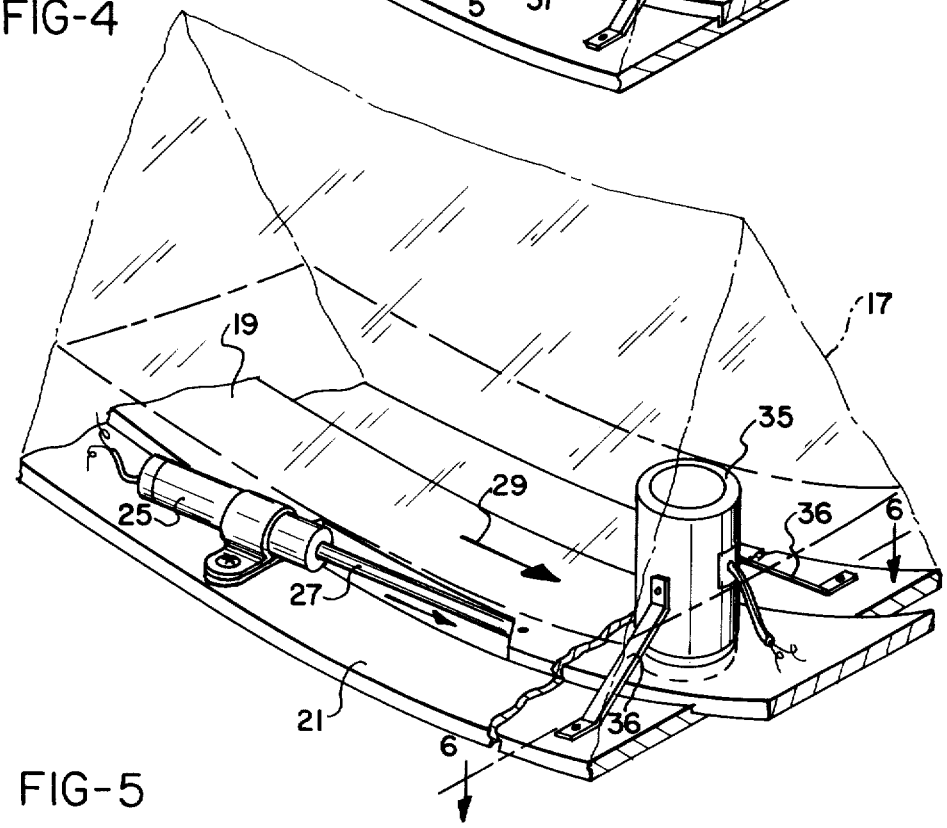
FIG. 4 schematically illustrates the action of the thruster and the moving of the detonator and booster charges into alignment arming the projectile.
Figure 5:
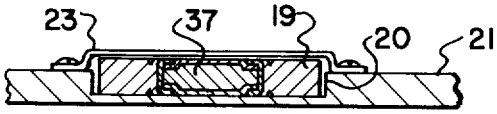
FIG. 5 schematically illustrates a sectional view through a booster charge of a suitable moving ring and track arrangement.
Figure 6:
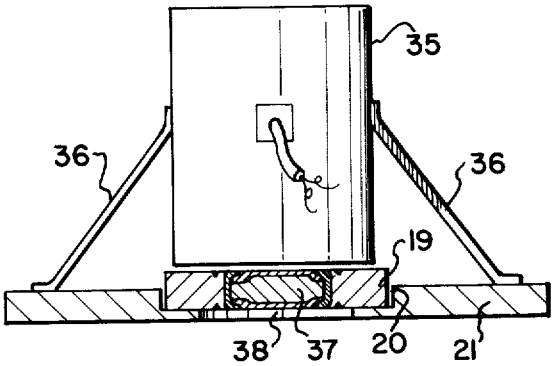
FIG. 6 schematically illustrates the relationship of the charges in the armed condition.

The fuze components are typically mounted above a movable ring and fixed track arrangement in the fuze enclosure. A typical embodiment is shown in the general overall pictorial schematic view of FIG. 2 and further detailed in the remaining figures of the drawing. Referring to FIGS. 2 through 6, a movable ring 19 is positioned in a recess 20 in a track 21 as shown in detail in FIGS. 5 and 6. The ring is held in the track by retaining straps 23. The movable ring 19 has two predetermined defined locating positions, the safe position, as illustrated in FIGS. 2, 3, and 5, and the armed position as illustrated in FIGS. 4 and 6. In the safe position, the ring is held in position and prevented from rotation by the thruster 25. Thruster 25 is attached to the track 21. It has actuating arm 27 attached in pivotal relationship to the ring 19. When the thruster 25 is actuated by an electric voltage, arm 27 extends and moves the ring in direction 29. Generally a conventional electrically fired pyrotechnic thruster is preferred due to its thrust to size and weight advantage. The slight delay in a pyrotechnic thruster developing its thrust after electrical ignition is beneficial in that the peak acceleration forces have passed and frictional forces on the movement of the ring are much lower for rotating the ring. Other electrically actuated thrusters such as pneumatic or hydraulic may however be used when feasible. The direction of ring rotation with respect to projectile rotation is not critical. After the thruster moves the ring to the armed position, the ring is further locked in place to prevent any additional movement by latch 31, which is attached to the track, engaging notch 33 in the ring. The fuze components, except for the booster charges, are positioned and held in place typically by a combination of mechanical attachment and by being cast in plastic. Generally, their means of support are not critical. These components are fixed relative to the track. The booster charges 37 are positioned in the ring 19 and move with it.

As previously indicated, general safety requirements mandate that before arming two or more forces, characteristic of launch, be sensed by the arming mechanism of the fuze. This provides a munition that may be normally handled and transported with reasonable safety. In addition, as also previously mentioned, it is required that in the unarmed condition, should a malfunction occur and an initiating charge, or charges, accidently fire that the entire projectile shall not detonate. This invention provides a fuze for projectiles that fulfills all these requirements. In the unarmed condition, as illustrated in FIGS. 2 and 3, the electronically fired conventional detonator or initiator charges 35, which typically may be attached to the track 21 by supporting brackets 36 and positioned with a small clearance above the movable ring 19, are in noncommunicable firing relationship with either the main charge or the booster charges 37. The conventional booster charges 37 are quite often termed relay charges due to their transferring or relaying, in the armed condition, the ignition from the detonator charges to the main charge. In the unarmed condition should a detonator charge 35 accidentally fire, the flame is blocked by the solid surface of ring 19 from reaching the main charge. The associated booster charge 37 is sufficiently removed from the detonator 35 that the possibility of it being ignited is quite remote. Further, should the booster charge ignite, it is over the solid area of the track as illustrated in FIG. 5, in the unarmed condition, and its ignition is not transferred to the main charge. When the projectile is armed by thruster 25 rotating the ring 19 containing the booster charges 37 so that the booster charges are positioned directly under the detonator charge 35, as illustrated in FIGS. 4 and 6, the flames from the detonators are communicated to the boosters and further communicated by the booster charges through a hole 38 in the track to the main charge, conventionally exploding the projectile.

The arming of the projectile by actuating the thruster accurs in two steps each indicative of the launching of the projectile. The first step is the sensing of the forward thrust of the launching of the projectile through the resulting set-back force, typically about a thousand G force. The second step is the sensing of the rotation of the projectile. The sensing of the launching set-back force is by a plurality of serially connected inertia sensors 41. Only a single inertia sensor would be necessary for operation of the fuze, however for additional safety it is desirable that more than one be used. As shown in the illustration, three inertia sensors sensing the set-back force of launching are generally considered the optimum number. With the sensors connected electrically in series all must be actuated in order to complete the first step in arming the projectile. Thus, it is quite unlikely, even under a severe blow which might cause one unit to activate, that the condition where three units would be activated other than under actual launching of the projectile is very remote.

The first step in arming is completed when the inertia sensors 41 are activated and electric power is connected to the electronic control circuit 43.

The inertia sensors 41 may be conventional inertia switches that operate or close when subjected to the normal set back forces of launch. Typically, they should close at an acceleration force (generally expressed in terms of a G force, i.e., magnitudes of acceleration of gravity) of approximately $\frac{1}{2}$ to $\frac{3}{4}$ that force typical of launch for the particular projectile involved. This provides a suitable reliability of arming factor combined with a reasonable factor of safety. Conventional inertia switches 41*a* as illustrated schematically in FIG. 13 may be used to connect a conventional battery 42 to the electronic circuitry, which will be later explained in detail.

Figure 14:
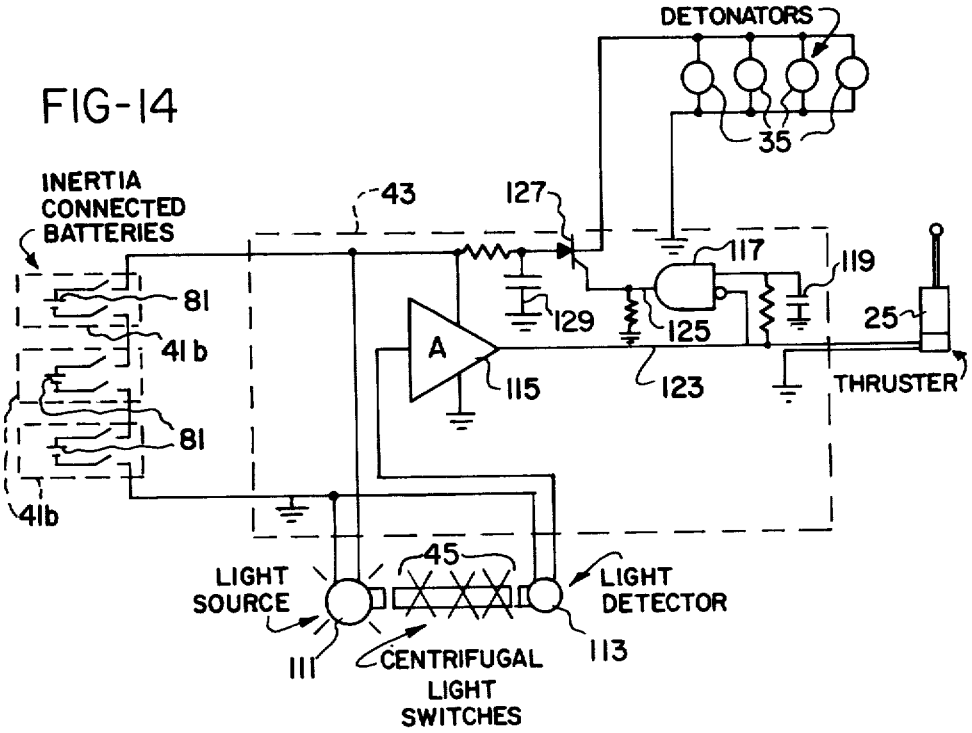
FIG. 14 is a schematic diagram of a typical embodiment of an electronic control circuit having an inertia activated power source.
Figure 7:
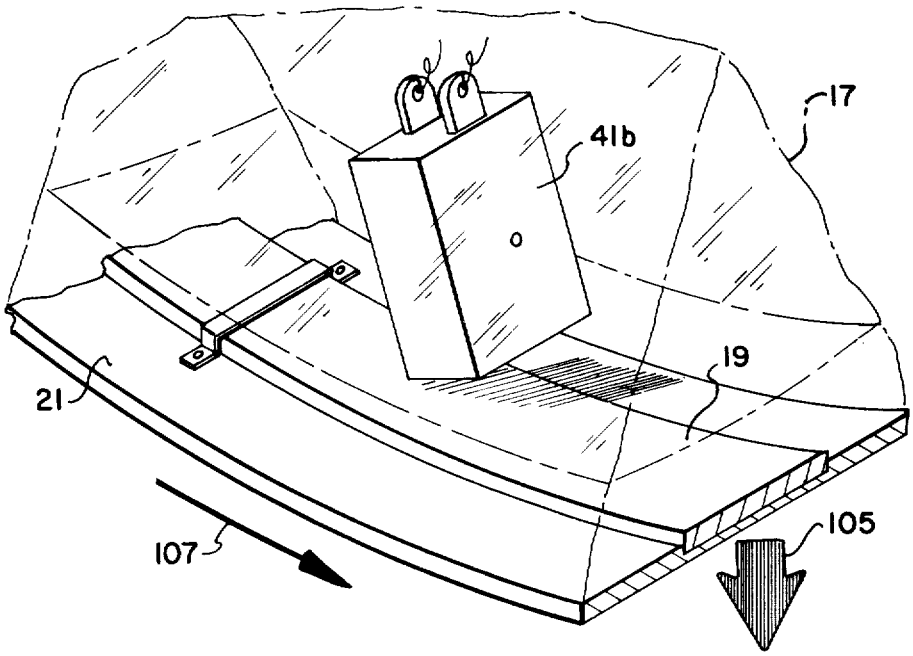
FIG. 7 schematically illustrates an inertia switch positioned above a section of a movable ring.
Figure 8:
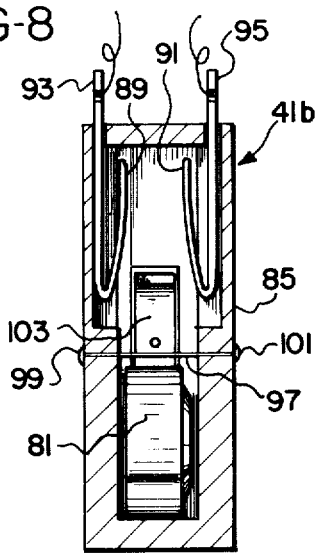
FIG. 8 schematically illustrates a side section view of the inertia switch illustrated in FIG. 6.
Figure 9:
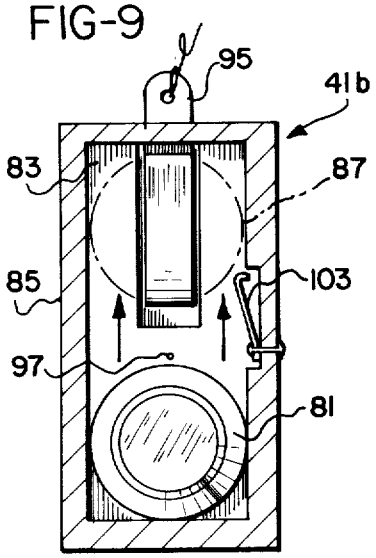
FIG. 9 schematically illustrates a front section view of the inertia switch illustrated in FIG. 6.

A preferred inertia activated power source, disclosed but not claimed herein, is shown in pictorial schematic form in FIGS. 7, 8, and 9, and in electronic-schematic form in FIG. 14. This power source 41*b* has a self contained battery 81, such as a conventional mercury cell, that is the moving element in the sensor. The cell, or battery as its commonly called, is contained in the elongated cavity 83 of housing 85. Under sufficient downward acceleration of the housing, the battery, due to its inertia, will slide from the lower end of the cavity to the upper end 87. In doing so, it wedges between the spring contacts 89 and 91 and the battery voltage is provided at terminal 93 and 95. However, before the battery can move appreciably it must shear the shear member 97. A small copper wire is a suitable shear member. In a typical embodiment the housing is conventionally fabricated from conventional printed circuit board material. The copper shear wire 97 is conventionally soldered at its ends 99 and 101 to the copper surface of the board. Any copper cladding should be removed from the housing near the terminals 93 and 95 to preclude the possibility of a short circuit. Spring latch 103 readily compresses into a recess to as the battery moves from the lower to the upper position. After the battery has passed the latch it moves back out prohibiting the battery from moving away from the contacts once contact has been established. Those practicing this invention will readily calculate the approximate size of the shear wire considering the shearing constant of the material of the wire, the mass of the battery, and the G force involved in the launching of the projectile.

It is generally desirable to slightly angle the inertia actuated power source 41*b*, as illustrated in FIG. 7 so that the motion of the battery is more nearly in a line that is the resultant of the forward acceleration 105 and the rotational acceleration 107. This angling of the inertia sensor is not critical.

The second stage of arming is the sensing of the rotation of the projectile by centrifugally activated light circuit switches 45. Preferably, three light circuit switches connected in a series optical relationship are used. Three series connected switches approximately 120 degrees apart provide a very reliable rotation indicator. If only a single switch is used a severe side shock could move the arm to the "on" condition. Two switches 180 degrees apart would be quite susceptible to vibrations in the plane of the switches. Two switches at 90 degrees apart might be actuated by a shock along the bisector of their angle, thus, three switches are preferred for safety.

Figure 10:
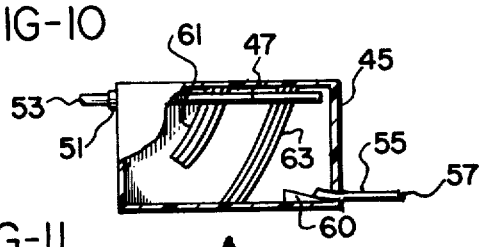
FIG. 10 is a schematic illustration of a cut-away plan view of a typical embodiment of a centrifugally actuated fiber optic switch in the open or off position.
Figure 11:
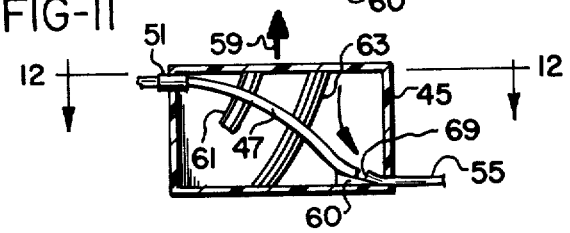
FIG. 11 is a schematic plan view in section, illustrating the switch illustrated in FIG. 10 in the closed or on position.
Figure 12:
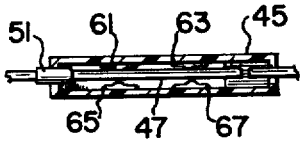
FIG. 12 is a schematic elevation section view of the switch illustrated in FIGS. 10 and 11.

The structure of a centrifugally actuated light circuit switch is disclosed in schematic-pictorial presentation in FIGS. 10, 11, and 12. The moving element of the switch is a fiber optic cantilever rod 47. The rod is supported by, and attached to, the switch case at one end 51. When not subject to any external forces, the fiber optic rod 47 is straight and positioned close to the case wall as illustrated in FIG. 10. The switch as shown in FIG. 10 is considered in the open or off position. Thus, if light is propagating through the fiber optic rod at 53, no light enters the fiber optic rod 55 to propagate through it at 57 for later detection. When the switch is place under an acceleration 59, the inertia of the fiber optic rod causes it to bend away from the direction of acceleration. Under a large enough acceleration force, the stiffness of the fiber optic rod is overcome to the extent that the free end of the rod rests on stop 60. The free end of the rod is thus aligned with the end of fiber optic rod 55 placing the switch in the closed or on condition. Light can now propagate in either direction though the switch. Guide rails 61, 63, 65, and 67 support the fiber optic rod 47 under extraneous forces in other directions than the major component of acceleration 59 so that should side forces be present in addition to the desired actuating force, the free end of the rod 47 will, when against the stop 60, be in alignment with the end 69 of fiber optic rod 55. The rails, in addition to preserving the alignment of the movable rod, also tend to reduce friction. The position and material of the rails are not critical.

The centrifugally actuated fiber optic light circuit switches 45 are connected in an optical series arrangement by fiber optic rod elements which ideally are continuations of the switch elements, as illustrated in FIG. 2. Light is induced into one end of the series chain of light switches and when all the switches close, indicating rotation, it is detected at the other end of the chain. It is immaterial which end of the light circuit it is that receives the illumination and at which end the detector is located. In the embodiment illustrated in FIG. 2, light emitter 111 injects light into the series optical circuit, and detector 113 detects the presence of light traversing the circuit. Electrical connecting wires to the light emitter and to the light detector from control circuit 43 are pictorially represented by lines 115 and 117 respectively. No attempt is made to pictorially illustrate all the electrical connections in FIG. 2 as it would unduly complicate the drawing and be confusing. Typical electrical circuits are shown in the electrical schematic diagrams of FIGS. 13 and 14. A person skilled in the art practicing this invention will readily make suitable wiring connections. Either point-to-point wiring or printed circuit board techniques may be used. Generally, a combination of both will be the most convenient.

Generally, the individual components of the electrical circuit of the invention are not critical. The frequency of the light used in the light circuit is also not critical other than the obvious criteria that the response characteristics of the detector generally be compatible with the emission characteristics of the emitter. Conventional light emitting diodes (LED) and conventional silicon PIN photo diode detectors are suitable light sources and detectors. A typical example of an embodiment of the centrifugally actuated fiber optic light switch has a cantilever fiber optic rod approximately one-half inch long from the supporting wall of the case to the free end of the rod. The free movement of the end of the rod is approximately one-quarter inch. The diameter of the rod is approximately 30 thousandths of an inch. This particular embodiment for a particular projectile closes at approximately 10% of maximum rotational velocity, and reopens at approximately the same velocity. In some instances where the optic switch is designed to close at a relative small percentage of peak rotational velocity it may be desirable to extend the stop 60 or to provide an additional stop approximately at the position of the center of the rod for the desired actuating velocity. This additional stop then prevents overstressing and possibly fracturing of the rod at extremely high rotational velocities.

It should be noted that the outward force on a body rotating about a center of rotation is generally termed a centrifugal force. This same force may also be considered an inertia force brought about by the body accelerating toward the center of rotation. Thus, rotation may be sensed with sensors that are called either centrifugal, acceleration, or inertia sensors.

Figure 13:
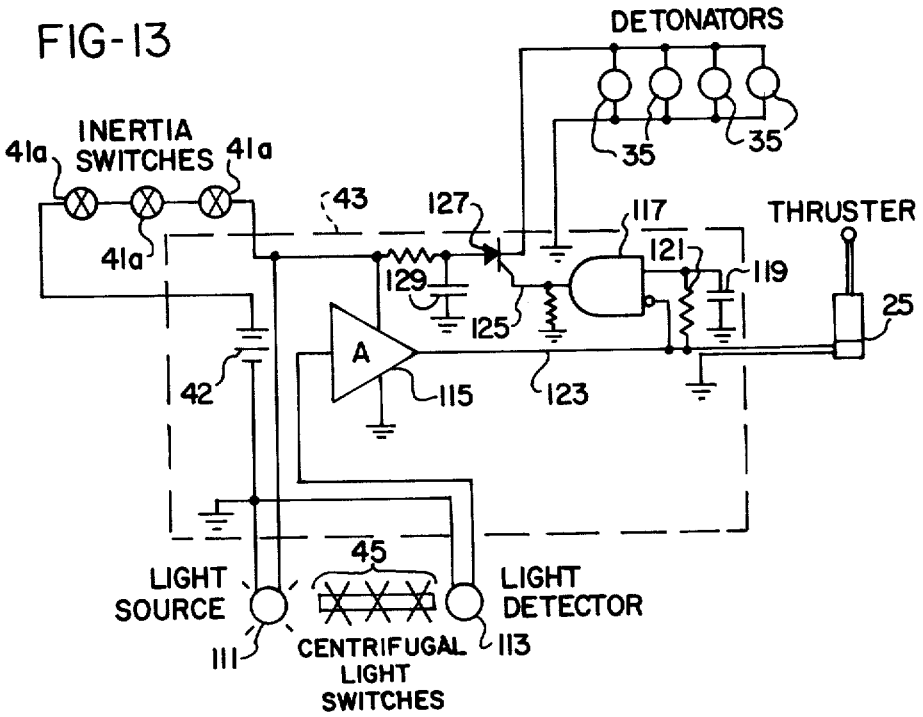
FIG. 13 is a schematic diagram of a typical embodiment of an electronic control circuit having separate inertia power switches and a common battery.

Referring to the electronic schematic diagrams of FIGS. 13 and 14, the inertia switches **41*a* or the inertia connected battery power source 41*b* are activated by the set-back force of the launching thrust. This connects the electrical power source to the electronics of the control circuit 43, i.e., the conventional solid state amplifier 115, and the conventional logic circuitry module 117 (the power connections to the logic module are not diagramed, but meant to be understood), and to the light source 111. This completes the first stage of arming. Rotation of the projectile closes the series connected centrifugal light switches 45. The light detector 113 detects the light coming through the closed light switches signifying rotation, and the resulting signal voltage from the detector is amplified in amplifier 115. Amplifier 115 provides an output voltage responsive to the light detector and this output voltage electrically fires the pyrotechnic thruster 25. The firing of the thruster rotates ring 19** as previously explained and the projectile is fully armed and in its trajectory toward the target. As the conventional thruster fires it open-circuits its electrical input connection.

When rotation of the projectile stops, or drops below that centrifugal force required to keep all the light circuit switch closed, the signal from the light detector 113 ceases. Likewise, the signal from amplifier 115 ceases, the detonators 35 fire and the projectile is exploded. The action of a suitable logic circuit to accomplish the foregoing is illustrated in FIGS. 13 and 14. When no signal is present on line 123 but power has been applied, there is no output on line 125 due to the inversion on the lower input of the AND gate. When a signal voltage is present on line 123 there is also no output on line 125 due to signal being present on the upper input to the AND gate and an inversion on the lower input. During this time capacitor 119 becomes charged. When the signal is then removed from line 123, capacitor 119 maintains the signal to the upper AND gate input and by an inversion of the "0" signal on the lower input the AND gate conducts and voltage is placed on line 125 triggering the silicon controlled rectifier 127 and dumping the charge on capacitor 129 through the detonators firing them. The RC circuit 119-121 is a conventional RC circuit. Those practicing this invention will conventionally chose values for the RC time constant compatible with the other parameters of the circuit and the operating conditions as taught herein.

It is to be noted that while the opening and closing of the light circuit switches occurs nominally at the same numerical value, that generally the closing of all the light circuit switches will occur at a slightly greater velocity of rotation than the opening of one of the series connected light switches due to the velocity being under a state of increase on the former and state of decrease in the latter.

While the principles of the invention in connection with specific apparatus have been described, i.e., a ring air foil shape projectile to which the invention is particularly suited, the invention is equally adaptable to other types of projectile, thus it is to be understood that the foregoing detailed description is made by way of example only and not as a limitation to the scope of the invention as set force in the accompanying claims.

What is claimed is:

1. A fuze for arming and exploding a projectile, the said projectile being launched along a longitudinal axis of rotation, the said fuze comprising:

a. a source of electrical energy;

b. an electronic control circuit having a power input, a signal input, a first signal output responsive to a first signal input, and a second signal output responsive to a second signal input;

c. means for sensing the said launching thrust of the projectile and responsive thereto connecting the said source of electrical energy to the said power input of the electronic control circuit whereby the control circuit is energized;

d. an electric signal fired detonator charge communicating with the said second signal output of the said electronic control circuit;

e. a booster charge;

f. means initially positioning the said booster charge and the said detonator charge in spaced apart non-communicable firing relationship;

g. means initiated by an electric signal, communicating with the said first signal output of the electronic control circuit, for moving the said booster charge and the said detonator charge into communicable firing relationship;

h. means for sensing a first predetermined condition of rotation of the said projectile and providing a first signal input to the electronic control circuit whereby the said booster charge and the said detonator charge are moved into communicable firing relationship; and i. means for sensing a second predetermined condition of rotation of the said projectile and providing a second signal input to the electronic control circuit whereby the said electronic control circuit provides the said second signal output firing the said detonator exploding the projectile.

2. The fuze as claimed in claim 1 wherein the said means for sensing the said launching includes an inertia activated switch.

3. The fuze as claimed in claim 1 wherein the said first predetermined condition of rotation is a predetermined first magnitude of velocity of rotation and the said second predetermined condition of rotation is a predetermined second magnitude of velocity of rotation smaller than said first magnitude.

4. The fuze as claimed in claim 1 wherein the said first predetermined condition of rotation is a predetermined increasing magnitude of velocity of rotation and the said second predetermined condition of rotation is a predetermined decreasing in magnitude of velocity of rotation.

5. The fuze as claimed in claim 4 wherein the absolute values of the said increasing and decreasing magnitudes of velocity of rotation are nominally the same numerical value.

6. The fuze as claimed in claim 1 wherein the said projectile is a ring air foil shape high explosive projectile and has a metal casing with a leading end and a trailing end and the said fuze is contained in an enclosure attached to the trailing end of the casing and the said enclosure has a shape fairing in with the shape of the projectile.

7. The fuze as claimed in claim 1 wherein the said means for sensing a predetermined first magnitude of velocity of rotation and the said means for sensing a predetermined second magnitude of velocity of rotation is a centrifugal force actuated fiber optic light circuit switch.

8. The fuze as claimed in claim 1 wherein the said means for moving the said booster charge and the said detonator charge into communicable firing relationship includes an electric signal fired pyrotechnic thruster.

9. A two stage arming sytem for a cased ring airfoil shape high explosive projectile, the said projectile launched in rotation about a longitudinal axis, the said system comprising:

a. a circular track attached to the said projectile casing in concentric relationship with the said longitudinal axis;

b. a movable ring positioned in the said track;

c. a plurality of booster charges positioned in predetermined spaced apart relationship in the said movable ring for communicating in firing relationship with the said high explosive of the projectile;

d. a plurality of detonator charges attached to the said track, positioned over the said movable ring in one-to-one spaced apart correspondence with the said booster charges;

e. means for providing a first positioning of the said movable ring placing the said plurality of booster charges in non-communicative firing relationship with the said plurality of detonator charges;

f. an electrically fired pyrotechnic thruster cooperating with the said track and with the movable ring for moving the said ring with the said plurality of booster charges into communicative firing with the said plurality of detonator charges;

g. means including an electronic circuit for firing the said thruster;

h. means for sensing the said launch of the said projectile and electrically activating the said electronic circuit whereby the first stage of arming occurs; and i. means for sensing a predetermined velocity of rotation of the projectile cooperating with the said electronic circuit whereby the said thruster is fired placing the said booster charges and the said detonator charges in communicative firing relationship completing the second stage of arming whereby the said projectile is fully armed.

10. The arming system as claimed in claim 9 wherein the said means for sensing the said launch of the projectile and electrically activating the said electronic circuit includes an inertia activated electrical power source.

11. The arming system as claimed in claim 9 wherein the said means for sensing the rotation of the projectile includes a plurality of centrifugally actuated fiber optic light circuit switches connected in series optical relationship.

12. The arming system as claimed in claim 9 wherein the said means for sensing the rotation of the projectile includes a plurality of fiber optic light circuit accelerometers connected in series optical relationship whereby at a predetermined velocity of rotation of the said projectile the light circuit through the accelerometers is completed.

13. An arming and detonating system for a ring airfoil high explosive projectile, the said projectile being launched with a forward acceleration and angular rotation, the said system comprising:

a. means responsive to the said forward acceleration providing a first electrical signal;

b. means responsive to said angular rotation and to the said first electrical signal providing a second electrical signal;

c. a first plurality of explosive charges radially positioned in a first plane in predetermined angularly spaced appart relationship;

d. a second plurality of explosive charges in one-to-one correspondence with said first plurality of charges, radially positioned in a second plane in corresponding predetermined angularly spaced apart relationship;

e. a first means for positioning the said first plane and the said second plane in relative relationship such that the said first plurality of explosive charges and the said second plurality of explosive charges are in non-communicable firing relationship;

f. means responsive to the said second electrical signal for positioning the said first plurality of explosive charges and the said second plurality of explosive charges in communicable firing relationship; and g. means responsive to a cessation of the said second electrical signal detonating said projectile.

* * * * *